US007987090B2

(12) United States Patent
Takeda et al.

(10) Patent No.: US 7,987,090 B2
(45) Date of Patent: Jul. 26, 2011

(54) SOUND-SOURCE SEPARATION SYSTEM

(75) Inventors: Ryu Takeda, Wako (JP); Kazuhiro Nakadai, Wako (JP); Hiroshi Tsujino, Wako (JP); Hiroshi Okuno, Kyoto (JP)

(73) Assignee: Honda Motor Co., Ltd., Tokyo (JP)

( * ) Notice: Subject to any disclaimer, the term of this patent is extended or adjusted under 35 U.S.C. 154(b) by 567 days.

(21) Appl. No.: 12/187,684

(22) Filed: Aug. 7, 2008

(65) Prior Publication Data

US 2009/0043588 A1 Feb. 12, 2009

Related U.S. Application Data

(60) Provisional application No. 60/954,889, filed on Aug. 9, 2007.

(30) Foreign Application Priority Data

Jul. 24, 2008 (JP) ..... 2008-191382

(51) Int. Cl.
*G10L 19/14* (2006.01)

(52) U.S. Cl. . 704/234; 704/233; 704/268; 704/E19.039; 702/190; 702/196

(58) Field of Classification Search ..... 704/233, 704/234, 268, E19.039; 702/190, 196
See application file for complete search history.

(56) References Cited

U.S. PATENT DOCUMENTS

| | | | | |
|---|---|---|---|---|
| 6,430,528 | B1 * | 8/2002 | Jourjine et al. | 704/200 |
| 6,898,612 | B1 * | 5/2005 | Parra et al. | 708/405 |
| 6,937,977 | B2 * | 8/2005 | Gerson | 704/201 |
| 7,440,891 | B1 * | 10/2008 | Shozakai et al. | 704/233 |
| 7,496,482 | B2 * | 2/2009 | Araki et al. | 702/190 |
| 7,650,279 | B2 * | 1/2010 | Hiekata et al. | 704/205 |
| 7,797,153 | B2 * | 9/2010 | Hiroe | 704/211 |
| 2003/0083874 | A1 * | 5/2003 | Crane et al. | 704/246 |
| 2005/0288922 | A1 * | 12/2005 | Kooiman | 704/208 |
| 2006/0136203 | A1 * | 6/2006 | Ichikawa | 704/226 |
| 2007/0185705 | A1 * | 8/2007 | Hiroe | 704/200 |
| 2007/0198268 | A1 * | 8/2007 | Hennecke | 704/270 |
| 2009/0222262 | A1 * | 9/2009 | Kim et al. | 704/231 |

OTHER PUBLICATIONS

Ikeda et al. "A Method of ICA in Time-Frequency Domain" 1999.*
Valin et al. "Enhanced Robot Audition Based on Microphone Array Source Separation with Post-Filter" 2004.*
Sawada et al. "A Robust and Precise Method for Solving the Permutation Problem of Frequency-Domain Blind Source Separation" 2004.*
Lee et al. "Blind Separation of delayed and convolved sources" 1997.*

(Continued)

*Primary Examiner* — Richemond Dorvil
*Assistant Examiner* — Greg Borsetti
(74) *Attorney, Agent, or Firm* — Rankin, Hill & Clark LLP

(57) ABSTRACT

A system capable of reducing the influence of sound reverberation or reflection to improve sound-source separation accuracy. An original signal X(ω,f) is separated from an observed signal Y(ω,f) according to a first model and a second model to extract an unknown signal E(ω,f). According to the first model, the original signal X(ω,f) of the current frame f is represented as a combined signal of known signals S(ω,f−m+1) (m=1 to M) that span a certain number M of current and previous frames. This enables extraction of the unknown signal E(ω,f) without changing the window length while reducing the influence of reverberation or reflection of the known signal S(ω,f) on the observed signal Y(ω,f).

2 Claims, 8 Drawing Sheets

CONVOLUTION IN TIME-FREQUENCY DOMAIN : SETTING OF TRANSFER FUNCTION ACCORDING TO DELAY FRAME

OTHER PUBLICATIONS

Kopriva et al. "An Adaptive Short-Time Frequency Domain Algorithm for Blind Separation of Nonstationary Convolved Mixtures" 2001.*

Saruwatari et al. "Two-Stage Blind Source Separation Based on ICA and Binary Masking for Real-Time Robot Audition System" 2005.*

Takeda et al. "Missing-Feature based Speech Recognition for Two Simultaneous Speech Signals Separated by ICA with a pair of Humanoid Ears" Oct. 2006.*

Yamamoto et al. "Real-Time Robot Audition System That Recognizes Simultaneous Speech in The Real World" Oct. 2006.*

Miyabe et al. "Interface for Barge-in Free Spoken Dialogue System Based on Sound Field Reproduction andMicrophone Array" vol. 2007 Issue 1, Jan. 1, 2007.*

Murata et al. "An approach to blind source separation based on temporal structure of speech signals" 2001.*

Yamamoto et al. "Improvement of Robot Audition by Interfacing Sound Source Separation and Automatic Speech Recognition with Missing Feature Theory" 2004.*

"Separation of speech signals under reverberant conditions", Christine Serviere, Proceedings of EUSIPCP 2004, Sep. 6, 2004, pp. 1693-1696, XP002503095.

"Springer Handbook of Speech Processing" Nov. 16, 2007. Springerberlin Heidelberg, XP002503096, p. 1077.

"Exploiting known sound source signals to improve ICA-based robot audition in speech separation and recognition", Intelligent Robots and Systems, 2007. IROS 2007. IEEE/RSJ International L Conferenceon, IEEE, Pl. Oct. 29, 2007, pp. 1757-1762, XP03122296.

A New Adaptive Filter Algorithm for System Identification using Independent Component Analysis, Jun-Mei Yang et al., pp. 1341-1344, Discussed on p. 2 of specification, English text, Apr. 2007.

Double-Talk Free Spoken Dialogue Interface Combining Sound Field Control With Semi-Blind Source Separation, Shigeki Miyabe et al., pp. 809-812, Discussed on p. 3 of specification, English text, 2006.

Polar Coordinate Based Nonlinear Function for Frequency-Domain Blind Source Separation, Hiroshi Sawada et al., pp. 590-595, Discussed on p. 4 of specification, English text, Mar. 2003.

* cited by examiner

CONVOLUTION IN TIME-FREQUENCY DOMAIN : SETTING OF TRANSFER FUNCTION ACCORDING TO DELAY FRAME

ONLINE PROCESSING BY LMS METHOD AND ICA METHOD
(WHERE FILTER INITIAL VALUE IS 0)

SOUND-SOURCE SEPARATION SYSTEM

BACKGROUND OF THE INVENTION

1. Field of the invention

The present invention relates to a sound-source separation system.

2. Description of the Related Art

In order to realize natural human-robot interactions, it is indispensable to allow a user to speak while a robot is speaking (barge-in). When a microphone is attached to a robot, since the speech of the robot itself enters the microphone, barge-in becomes a major impediment to recognizing the other's speech.

Therefore, an adaptive filter having a structure shown in FIG. 4 is used. Removal of self-speech is treated as a problem of estimating a filter $\hat{h}$, which approximates a transmission system h from a loudspeaker S to a microphone M. An estimated signal $\hat{y}(k)$ is subtracted from an observed signal y(k) input from the microphone M to extract the other's speech.

An NLMS (Normalized Least Mean Squares) method has been proposed as one of adaptive filters. According to the NLMS method, the signal y(k) observed in the time domain through a linear time-invariant transmission system is expressed by Equation (1) using convolution between an original signal vector $x(k)={}^t(x(k), x(k-1), \ldots, x(k-N+1))$ (where N is the filter length and t is transpose) and impulse response $h={}^t(h_1, h_2, \ldots h_N)$ of the transmission system.

$$y(k)={}^t x(k)h \tag{1}$$

The estimated filter $\hat{h}=t(\hat{h}1, \hat{h}2, \ldots, \hat{h}N)$ is obtained by minimizing the root mean square of an error e(k) between the observed signal and the estimated signal expressed by Equation (2). An online algorithm for determining the estimated filter $\hat{h}$ is expressed by Equation (3) using a small integer value for regularization. Note that an LSM method is the case that the learning coefficient is not regularized by $\|x(k)\|2+\delta$ in Equation (3).

$$e(k)=y(k)-{}^t x(k)\hat{h} \tag{2}$$

$$\hat{h}(k)=\hat{h}(k-1)+\mu_{NLMS}x(k)e(k)/(\|x(k)\|^2+\delta) \tag{3}$$

An ICA (Independent Component Analysis) method has also been proposed. Since the ICA method is designed to assume noise, it has the advantage that detection of noise in a self-speech section is unnecessary and noise is separable even if it exists. Therefore, the ICA method is suitable for addressing the barge-in problem. For example, a time-domain ICA method has been proposed (see J. Yang et al., "A New Adaptive Filter Algorithm for System Identification Using Independent Component Analysis," Proc. ICASSP2007, 2007, pp. 1341-1344). A mixing process of sound sources is expressed by Equation (4) using noise n(k) and N+1th matrix A:

$$^t(y(k),{}^t x(k))=A^t(n(k),{}^t x(k)),$$

$$A_{ii}=1\ (i=1, \ldots, N+1),\ A_{1j}=h_{j-1}\ (j=2, \ldots, N+1),$$

$$A_{ik}=0\ (k\neq i).$$

According to the ICA, an unmixing matrix in Equation (5) is estimated:

$$^t(e(k),{}^t x(k))=W^t(y(k),{}^t x(k)),$$

$$W_{11}=a, W_{ii}=1\ (i=2, \ldots, N+1),$$

$$W_{1j}=h_j\ (j=2, \ldots, N+1),\ W_{ik}=0\ (k\neq i). \tag{5}$$

The case that an element $W_{11}$ in the first row and the first column in the unmixing matrix W is a=1 is a conventional adaptive filter model, and this is the largest difference from the ICA method. K-L information is minimized using a natural gradient method to obtain the optimum separation filter according to Equations (6) and (7) representing the online algorithm.

$$\hat{h}(k+1)=\hat{h}(k)+\mu_1[\{1-\phi(e(k))e(k)\}\hat{h}(k)-\phi(e(k))x(k)] \tag{6}$$

$$a(k+1)=a(k)+\mu_2[1-\phi(e(k))e(k)]a(k) \tag{7}$$

The function $\phi$ is defined by Equation (8) using the density function $p_x(x)$ of random variable e.

$$\phi(x)=-(d/dx)\log p_x(x) \tag{8}$$

Further, a frequency-domain ICA method has been proposed (see S. Miyabe et al., "Double-Talk Free Spoken Dialogue Interface Combining Sound Field Control with SeMi-Blind Source Separation," Proc. ICASSP2006, 2006, pp. 809-812). In general, since a convolutive mixture can be treated as an instantaneous mixture, the frequency-domain ICA method has better convergence than the time-domain ICA method. According to this method, short-time Fourier analysis is performed with window length T and shift length U to obtain signals in the time-frequency domain. The original signal x(t) and the observed signal y(t) are represented as X(ω,f) and Y(ω,f) using frame f and frequency ω as parameters, respectively. A separation process of the observed signal vector $Y(\omega,f)={}^t(Y(\omega,f),X(\omega,f))$ is expressed by Equation (9) using an estimated original signal vector $\hat{Y}(\omega,f)={}^t(E(\omega,f),X(\omega,f))$.

$$Y(\omega,f)=W(\omega)Y(\omega,f),\ W_{21}(\omega)=0,\ W_{22}(\omega)=1 \tag{9}$$

The learning of the unmixing matrix is accomplished independently for each frequency. The learning complies with an iterative learning rule expressed by Equation (10) based on minimization of K-L information with a nonholonomic constraint (see Sawada et al., "Polar Coordinate based Nonlinear Function for Frequency-Domain Blind Source Separation," IEICE Trans., Fundamentals, Vol. E-86A, No. 3, March 2003, pp. 590-595).

$$W^{(j+1)}(\omega)=W^{(j)}(\omega)-\alpha\{\text{off-diag}\langle\phi(Y)Y^H\rangle\}W^{(j)}(\omega), \tag{10}$$

where $\alpha$ is the learning coefficient, (j) is the number of updates, <.> denotes an average value, the operation off-diagX replaces each diagonal element of matrix X with zero, and the nonlinear function $\phi(y)$ is defined by Equation (11).

$$\phi(y_i)=\tan h(|y_i|)\exp(i\theta(y_i)) \tag{11}$$

Since the transfer characteristic from existing sound source to existing sound source is represented by a constant, only the elements in the first row of the unmixing matrix W are updated.

However, the conventional frequency-domain ICA method has the following problems. The first problem is that it is necessary to make the window length T longer to cope with reverberation, and this results in processing delay and degraded separation performance. The second problem is that it is necessary to change the window length T depending on the environment, and this makes it complicated to make a connection with other noise suppression techniques.

Therefore, it is an object of the present invention to provide a system capable of reducing the influence of sound reverberation or reflection to improve the accuracy of sound source separation.

SUMMARY OF THE INVENTION

A sound-source separation system of the first invention comprises: a known signal storage means which stores known signals output as sound to an environment; a microphone; a first processing section which performs frequency conversion of an output signal from the microphone to generate an observed signal of a current frame; and a second processing section which removes an original signal from the observed signal of the current frame generated by the first processing section to extract the unknown signal according to a first model in which the original signal of the current frame is represented as a combined signal of known signals for the current and previous frames and a second model in which the observed signal is represented to include the original signal and the unknown signal.

According to the sound-source separation system of the first invention, the unknown signal is extracted from the observed signal according to the first model and the second model. Especially, according to the first model, the original signal of the current frame is represented as a combined signal of known signals for the current and previous frames. This enables extraction of the unknown signal without changing the window length while reducing the influence of reverberation or reflection of the known signal on the observed signal. Therefore, sound-source separation accuracy based on the unknown signal can be improved while reducing the arithmetic processing load to reduce the influence of sound reverberation.

A sound-source separation system of the second invention is based on the sound-source separation system of the first invention, wherein the second processing section extracts the unknown signal according to the first model in which the original signal is represented by convolution between the frequency components of the known signals in a frequency domain and a transfer function of the known signals.

According to the sound-source separation system of the second invention, the original signal of the current frame is represented by convolution between the frequency components of the known signals in the frequency domain and the transfer function of the known signals. This enables extraction of the unknown signal without changing the window length while reducing the influence of reverberation or reflection of the known signal on the observed signal. Therefore, sound-source separation accuracy based on the unknown signal can be improved while reducing the arithmetic processing load to reduce the influence of sound reverberation.

A sound-source separation system of the third invention is based on the sound-source separation system of the first invention, wherein the second processing section extracts the unknown signal according to the second model for adaptively setting a separation filter.

According to the sound-source separation system of the third invention, since the separation filter is adaptively set in the second model, the unknown signal can be extracted without changing the window length while reducing the influence of reverberation or reflection of the original signal on the observed signal. Therefore, sound-source separation accuracy based on the unknown signal can be improved while reducing the arithmetic processing load to reduce the influence of sound reverberation.

DESCRIPTION OF THE PREFERRED EMBODIMENT

An embodiment of a sound-source separation system of the present invention will now be described with reference to the accompanying drawings.

Figure 1:
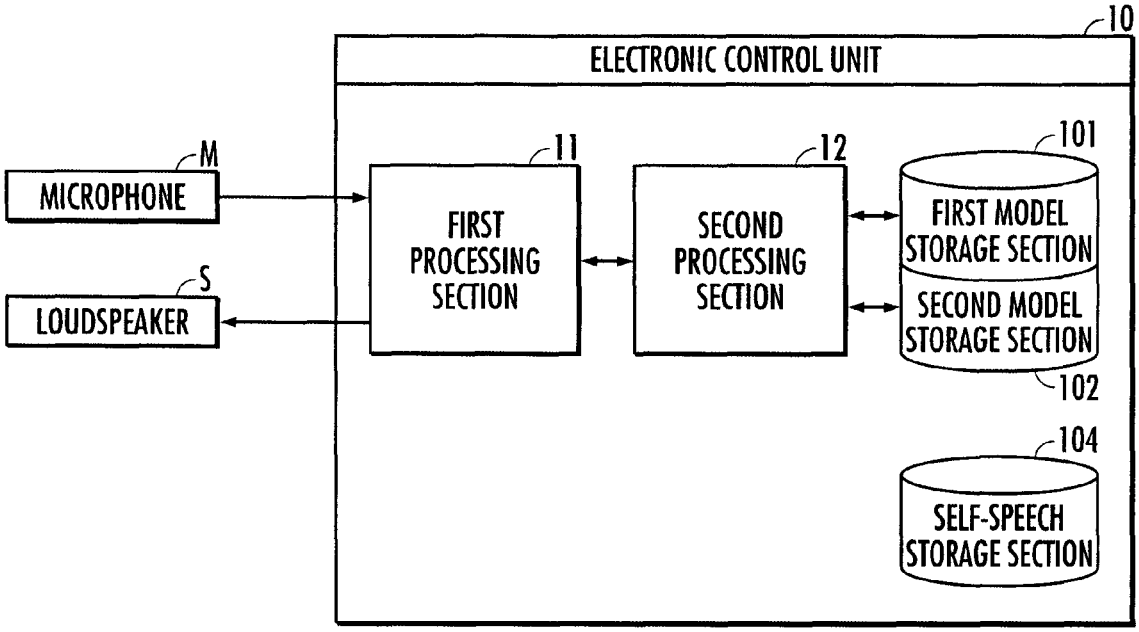
FIG. 1 is a block diagram of the structure of a sound-source separation system of the present invention.

The sound-source separation system shown in FIG. 1 includes a microphone M, a loudspeaker S, and an electronic control unit (including electronic circuits such as a CPU, a ROM, a RAM, an I/O circuit, and an A/D converter circuit) 10. The electronic control unit 10 has a first processing section 11, a second processing section 12, a first model storage section 101, a second model storage section 102, and a self-speech storage section 104. Each processing section can be an arithmetic processing circuit, or be constructed of a memory and a central processing unit (CPU) for reading a program from the memory and executing arithmetic processing according to the program.

The first processing section 11 performs frequency conversion of an output signal from the microphone M to generate an observed signal (frequency $\omega$ component) $Y(\omega,f)$ of the current frame f. The second processing section 12 extracts an unknown signal $E(\omega,f)$ based on the observed signal $Y(\omega,f)$ of the current frame generated by the first processing section 11 according to a first model stored in the first model storage section 101 and a second model stored in the second model storage section 102. The electronic control unit 10 causes the loudspeaker S to output, as voice or sound, a known signal stored in the self-speech storage section (known signal storage means) 104.

Figure 2:
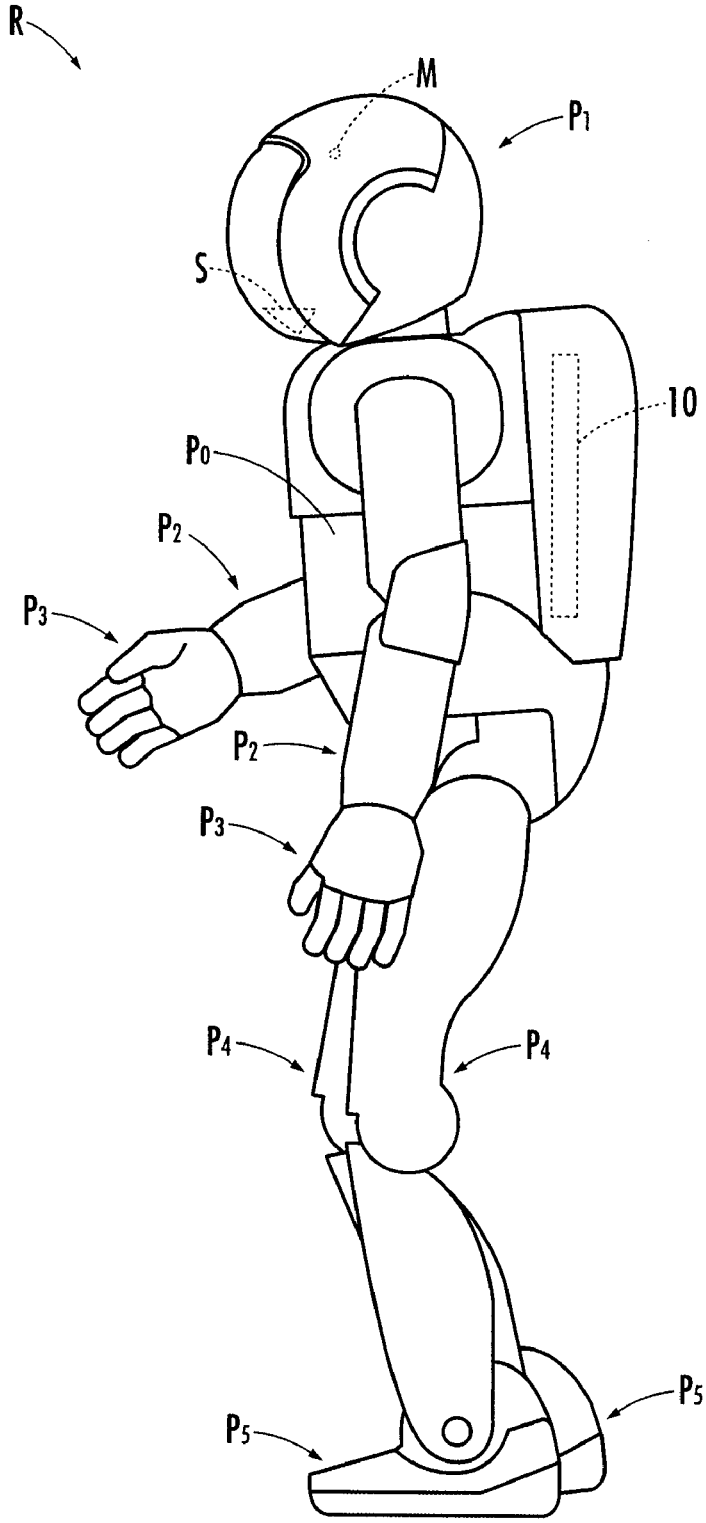
FIG. 2 is an illustration showing an example of installation, into a robot, of the sound-source separation system of the present invention.

For example, as shown in FIG. 2, the microphone M is arranged on a head P1 of a robot R in which the electronic control unit 10 is installed. In addition to the robot R, the sound-source separation system can be installed in a vehicle (four-wheel vehicle), or any other machine or device in an environment in which plural sound sources exist. Further, the number of microphones M can be arbitrarily changed. The robot R is a legged robot, and like a human being, it has a body P0, the head P1 provided above the body P0, right and left arms P2 provided to extend from both sides of the upper part of the body P0, hands P3 respectively coupled to the ends of the right and left arms P2, right and left legs P4 provided to extend downward from the lower part of the body P0, and feet P5 respectively coupled to the legs P4. The body P0 consists of the upper and lower parts arranged vertically to be relatively rotatable about the yaw axis. The head P1 can move relative to the body P0, such as to rotate about the yaw axis. The arms P2 have one to three rotational degrees of freedom at shoulder joints, elbow joints, and wrist joints, respectively. The hands P3 have five finger mechanisms corresponding to human thumb, index, middle, annular, and little fingers and provided to extend from each palm so that they can hold an object. The legs P4 have one to three rotational degrees of freedom at hip joints, knee joints, and ankle joints, respectively. The robot R can work properly, such as to walk on its legs, based on the sound-source separation results of the sound-source separation system.

The following describes the functions of the sound-source separation system having the above-mentioned structure. First, the first processing section 11 acquires an output signal from the microphone M (S002 in FIG. 3). Further, the first processing section 11 performs A/D conversion and frequency conversion of the output signal to generate an observed signal Y(ω,f) of frame f (S004 in FIG. 3).

Figure 3:
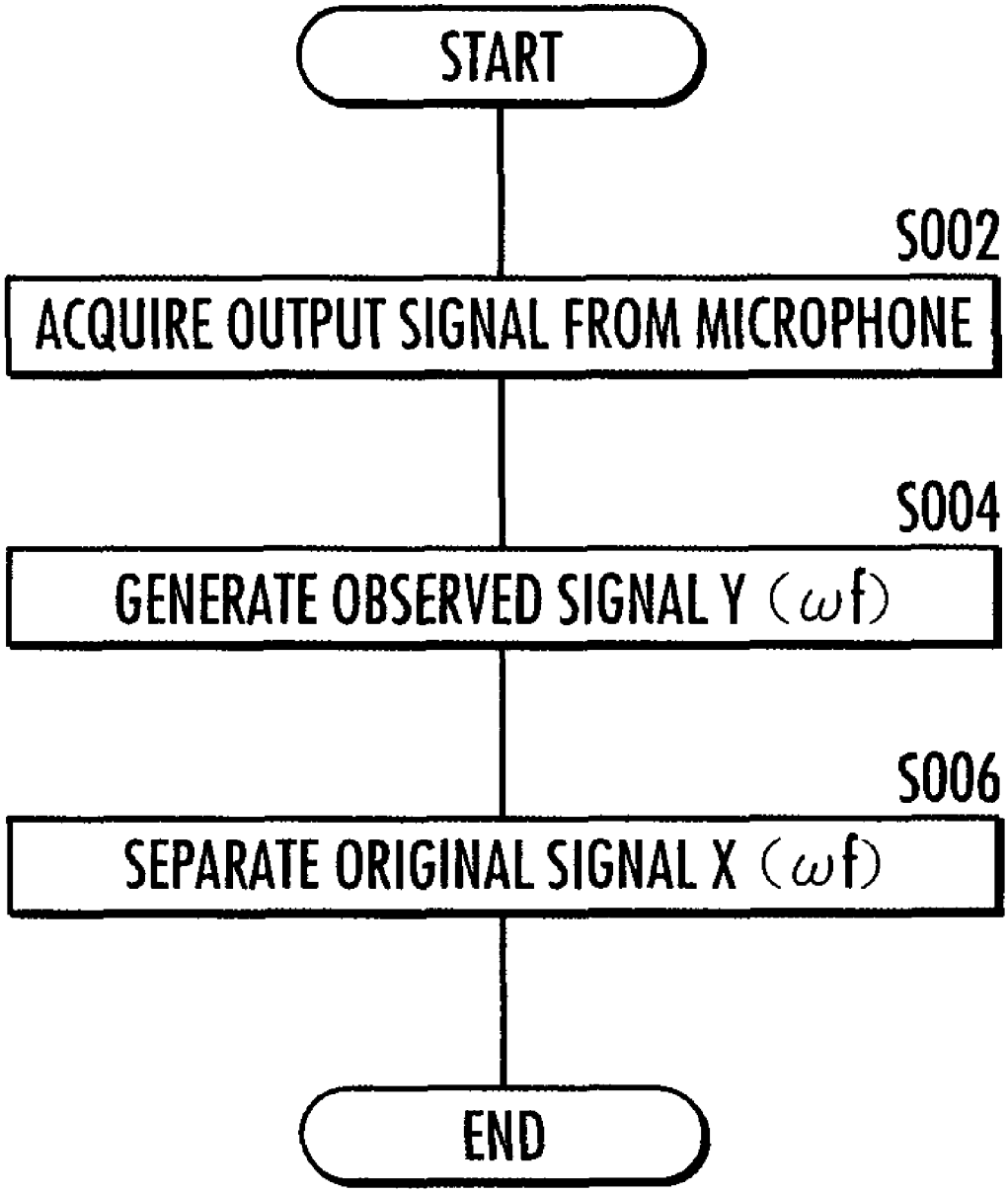
FIG. 3 is a flowchart showing the functions of the sound-source separation system of the present invention.
Figure 4:
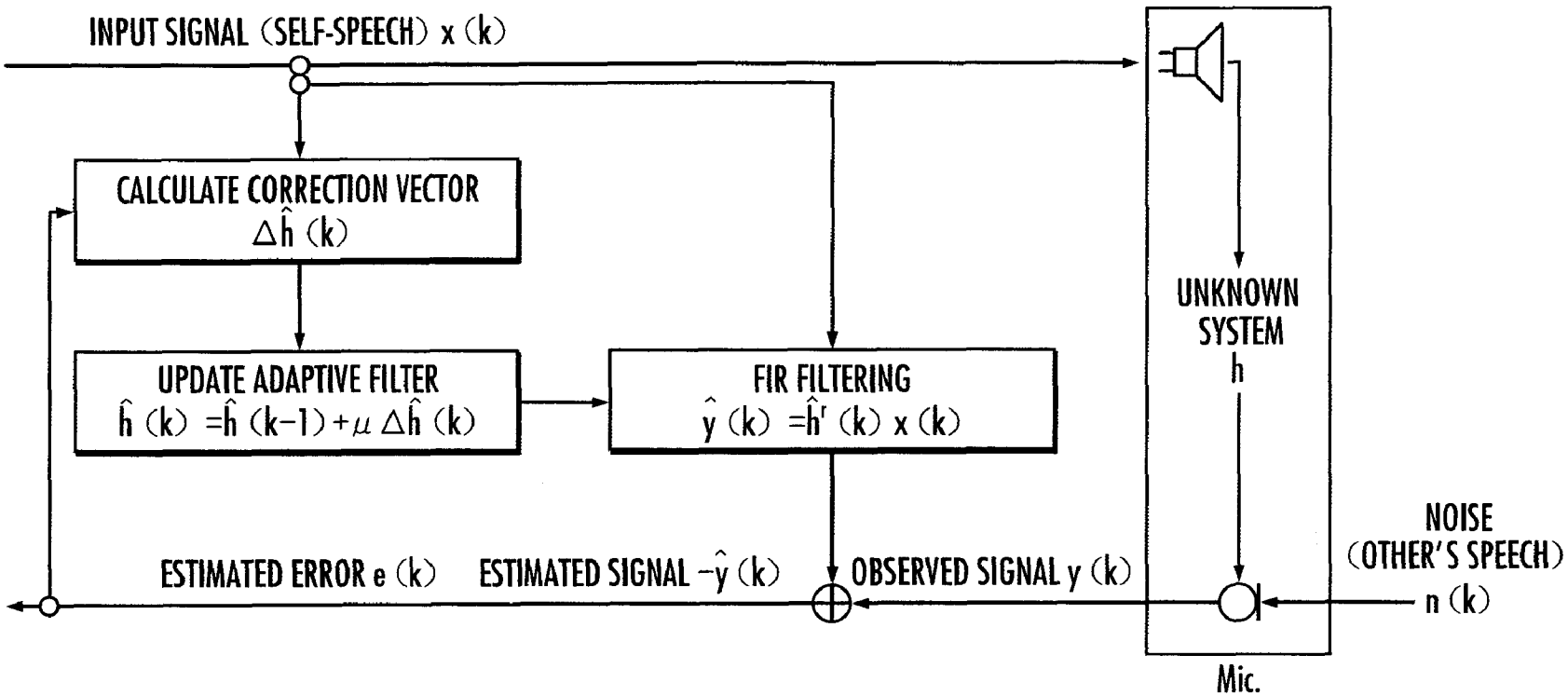
FIG. 4 is a schematic diagram related to the structure of an adaptive filter.

Then, the second processing section 12 separates, according to the first model and the second model, an original signal X(ω,f) from the observed signal Y(ω,f) generated by the first processing section 11 to extract an unknown signal E(ω,f) (S006 in FIG. 3).

According to the first model, the original signal X(ω,f) of the current frame f is represented to include original signals that span a certain number M of current and previous frames. Further, according to the first model, reflection sound that enters the next frame is expressed by convolution in the time-frequency domain. Specifically, on the assumption that a frequency component in a certain frame f affects the frequency components of observed signals over M frames, the original signal X(ω,f) is expressed by Equation (12) as convolution between a delayed known signal (specifically, a frequency component of the original signal with delay m) S(ω, f−m+1) and its transfer function A(ω,m).

$$X(\omega,f)=\Sigma_{m=1-M}A(\omega,m)S(\omega,f-m+1) \tag{12}$$

Figure 5:
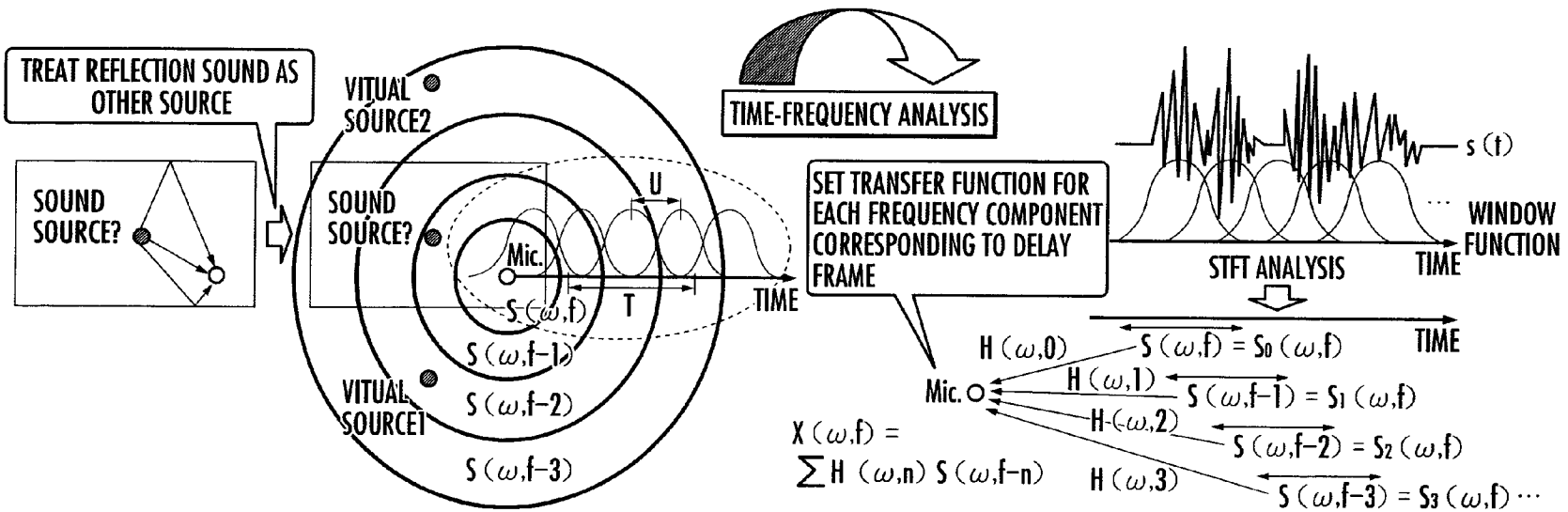
FIG. 5 is a schematic diagram related to convolution in the time-frequency domain.

FIG. 5 is a schematic diagram showing the convolution. The observed sound Y(ω,f) is treated as a mixture of convoluted unknown signal E(ω,f) and known sound (self-speech signal) S(ω,f) that subjected to a normal transmission process. This is a kind of multi-rate processing by a uniform DTF (Discrete Fourier Transform) filter bank.

According to the second model, the unknown signal E(ω,f) is represented to include the original signal X(ω,f) through the adaptive filter (separation filter) h^ and the observed signal Y(ω,f). Specifically, the separation process according to the second model is expressed as vector representation according to Equations (13) to (15) based on the original signal vector X, the unknown signal E, the observed sound spectrum Y, and separation filters h^ and c.

$$^t(E(\omega,f),{}^tX(\omega,f))=C^t(Y(\omega,f),{}^tX(\omega,f)),$$

$$C_{11}=c(\omega),\ C_{ii}=1\ (i=2,\ldots,M+1),$$

$$C_{1j}=h_{j-1}\hat{}\ (j=2,\ldots,M+1),\ C_{ki}=0\ (k\neq i) \tag{13}$$

$$X(\omega,f)={}^t(X(\omega,f),X(\omega,f-1),\ldots,X(\omega,f-M+1)) \quad 14)$$

$$h\hat{}(\omega)=(h_1\hat{}(\omega),h_2\hat{}(\omega),\ldots,h_M\hat{}(\omega)) \tag{15}$$

Although the representation is the same as that of the time-domain ICA method except for the use of complex numbers, Equation (11) commonly used in the frequency-domain ICA method is used from the viewpoint of convergence. Therefore, update of the filter h^ is expressed by Equation (16).

$$h\hat{}(f+1)=h\hat{}(f)-\mu_1\phi(E(f))X^*(f), \tag{16}$$

where X*(f) denotes the complex conjugate of X(f). Note that the frequency index ω is omitted.

Because of no update of the separation filter c, the separation filter c remains at the initial value $c_0$ of the unmixing matrix. The initial value $c_0$ is a scaling coefficient defined suitably for the derivative φ(x) of the logarithmic density function of error E. It is apparent from Equation (16) that if the error (unknown signal) E upon updating the filter is scaled properly, its learning is not disturbed. Therefore, if the scaling coefficient a is determined in some way to apply the function φ(aE) using this scaling coefficient, there is no problem if the initial value $c_0$ of the unmixing matrix is 1. For the learning rule of the scaling coefficient, Equation (7) can be used in the same manner as in the time-domain ICA method. This is because in Equation (7), a scaling coefficient for substantially normalizing e is determined. e in the time-domain ICA method corresponds to aE.

As stated above, the learning rule according to the second model is expressed by Equations (17) to (19).

$$E(f)=Y(f)-{}^tX(f)h\hat{}(f), \tag{17}$$

$$h\hat{}(f+1)=h\hat{}(f)+\mu_1\phi(a(f)E(f))X^*(f) \tag{18}$$

$$a(f+1)=a(f)+\mu_2[1-\phi(a(k)E(k))a^*(f)E^*(f)]a(f) \tag{19}$$

If the nonlinear function φ(x) meets such a format as r(|x|, θ((x))exp(iθ(x)), such as tan h(|x|)exp(iθ(x)), a becomes a real number.

According to the sound-source separation system that achieves the above-mentioned functions, the unknown signal E(ω,f) is extracted from the observed signal Y(ω,f) according to the first model and the second model (see S002 to S006 in FIG. 3). According to the first model, the observed signal Y(ω,f) of the current frame f is represented as a combined signal of original signals X(ω,f−m+1) (m=1 to M) that span the certain number M of current and previous frames (see Equation (12)). Further, the separation filter h^ is adaptively set in the second model (see Equations (16) to (19)). Therefore, the unknown signal E(ω,f) can be extracted without changing the window length while reducing the influence of sound reverberation or reflection of the original signal (ω,f) on the observed signal Y(ω,f). This makes it possible to improve the sound-source separation accuracy based on the unknown signal E(ω,f) while reducing the arithmetic processing load to reduce the influence of reverberation of the known signal S(ω,f).

Here, Equations (3) and (18) are compared. The extended frequency-domain ICA method of the present invention is different in the scaling coefficient a and the function φ from the adaptive filter in the LMS (NLMS) method except for the applied domain. For the sake of simplicity, assuming that the domain is the time domain (real number) and noise (unknown signal) follows a standard normal distribution, the function φ is expressed by Equation (20).

$$\phi(x)=-(d/dx)\log(\exp(-x^2/2))/(2\pi)^{1/2}=x \tag{20}$$

Since this means that φ(aE(t))X(t) included in the second term on the right side of Equation (18) is expressed as aE(t) X(t), Equation (18) becomes equivalent to Equation (3). This means that, if the learning coefficient is defined properly in Equation (3), update of the filter is possible in a double-talk state even by the LMS method. In other words, if noise follows the Gaussian distribution and the learning coefficient is set properly according to the power of noise, the LMS method works equivalently to the ICA method.

Figure 6:
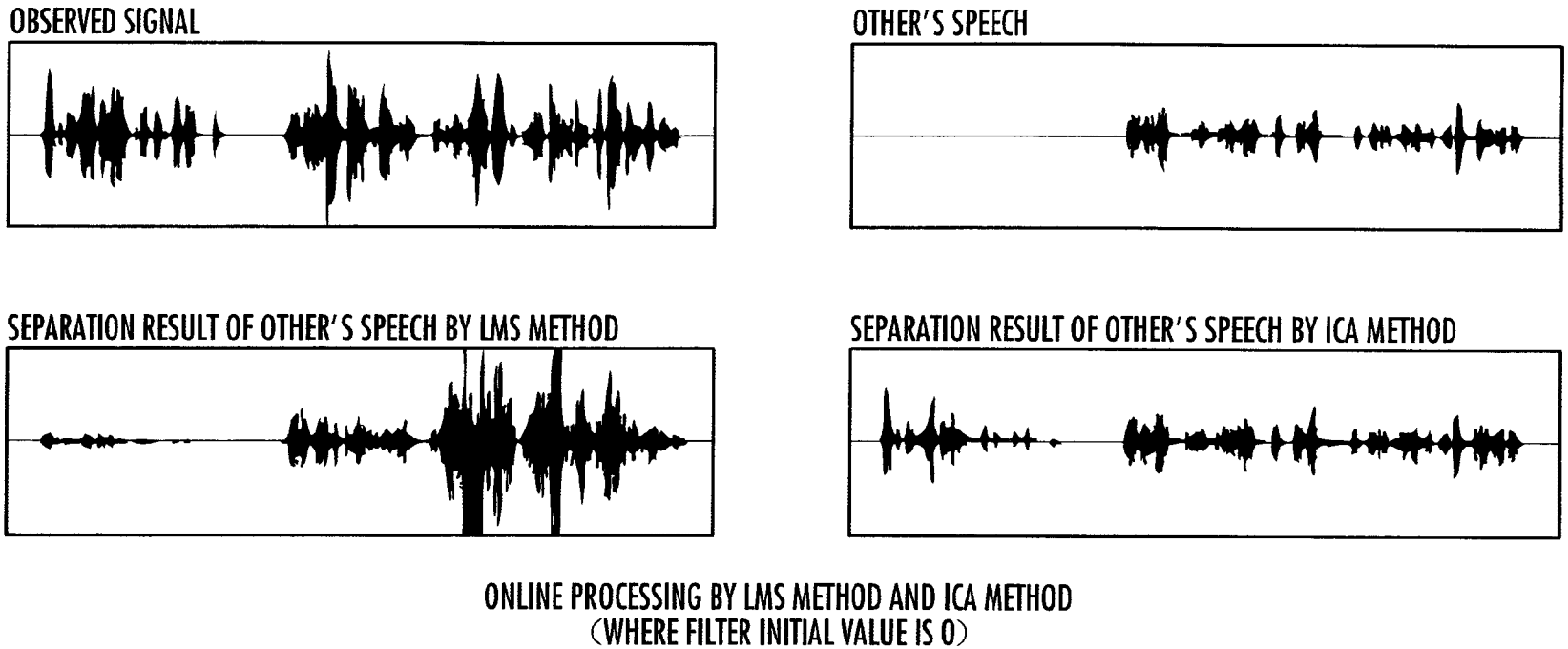
FIG. 6 is a schematic diagram related to the results of separation of the other's speech by LMS and ICA methods.

FIG. 6 shows separation examples by the LMS method and the ICA method, respectively. The observed sound is only the self-speech in the first half, but the self-speech and other's speech are mixed in the second half. The LMS method converges in a section where no noise exists but it is unstable in the double-talk state in which noise exists. In contrast, the ICA method is stable in the section where noise exists through it converges slowly.

The following describes experimental results of continuous sound-source separation performance by A. time-domain NLMS method, B. time-domain ICA method, C. frequency-domain ICA method, and D. technique of the present invention, respectively.

Figure 7:
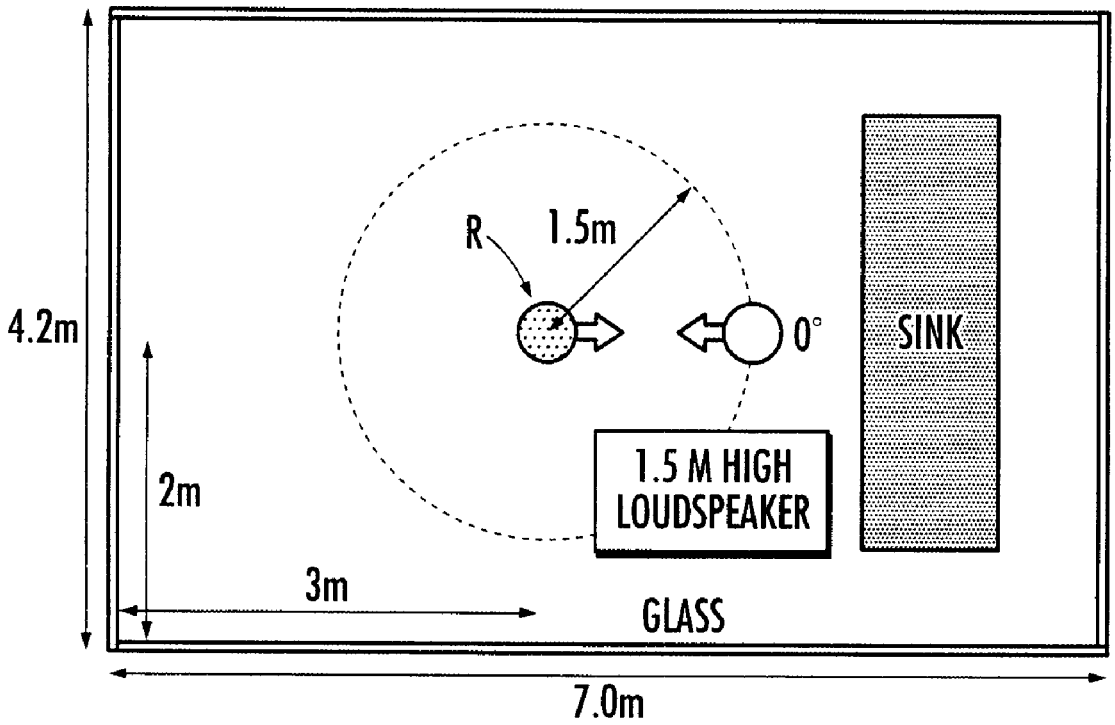
FIG. 7 is an illustration related to experimental conditions.

In the experiment, impulse response data were recorded at a sampling rate of 16 kHz in a room as shown in FIG. 7. The room was 4.2 m×7 m and the reverberation time (RT60) was about 0.3 sec. A loudspeaker S corresponding to self-speech was located near a microphone M, and the direction of the loudspeaker S to face the microphone M was set as the front direction. A loudspeaker corresponding to the other's speech was placed toward the microphone. The distance between the microphone M and the loudspeaker was 1.5 m. A set of ASJ-JNAS 200 sentences with recorded impulse response data convoluted (where 100 sentences were uttered by each of male and female speakers) was used as data for evaluation. These 200 sentences were set as the other's speech, and one of these sentences (about 7 sec.) was used for self-speech. The mixed data are aligned at the beginning of the other's speech and self-speech but they are not aligned at the end.

Julius was used as a sound-source separation engine (see http://julius.sourceforge.jp/). A triphone model (3-state, 8-mixture HMM) trained with ASJ-JNAS newspaper articles of clean speech read by 200 speakers (100 male speakers and 100 female speakers) and a set of 150 phonemically balanced sentences was used as the acoustic model. A 25-dimensional MFCC (12+Δ12+ΔPow) was used as sound-source separation features. The learning data do not include the sounds used for recognition.

To match the experimental conditions, the filter length in the time domain was set to about 0.128 sec. The filter length for the method A and the method B is 2,048 (about 0.128 sec.). For the present technique D, the window length T was set to 1,024 (0.064 sec.), the shift length U was set to 128 (about 0.008 sec.), and the number M of delay frames was set to 8, so that the experimental conditions for the present technique D were matched with those for the method A and the method B. For the method C, the window length T was set to 2048 (0.128 sec.), and the shift length U was set to 128 (0.008 sec.) like the present technique D. The filter initial values were all set to zeros, and separation was performed by online processing.

As the learning coefficient value, a value with the largest recognition rate was selected by trial and error. Although the learning coefficient is a factor that decides convergence and separation performance, it does not change the performance unless the value largely deviates from the optimum value.

Figure 8:
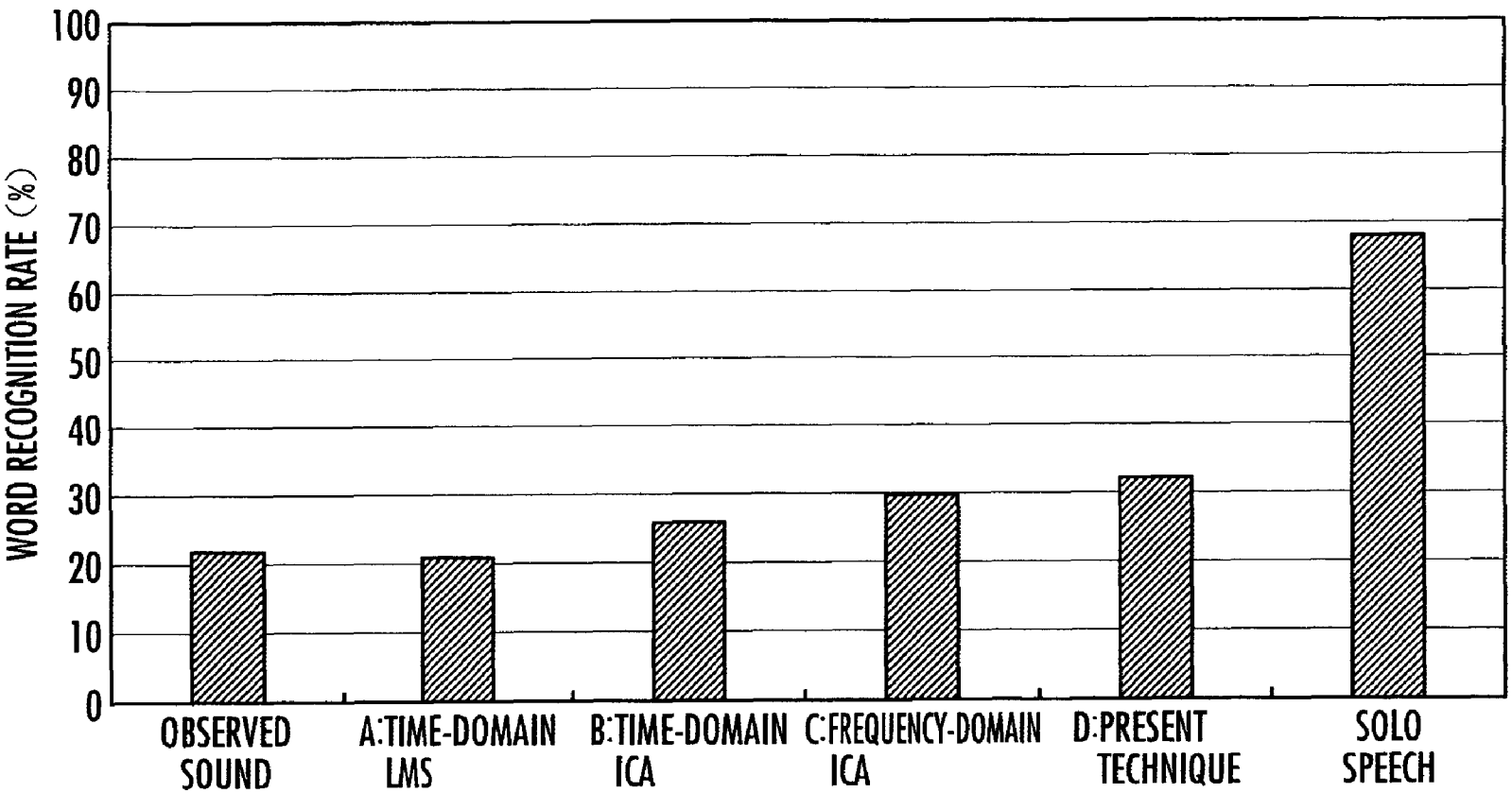
FIG. 8 is a bar chart for comparing word recognition rates as sound-source separation results of respective methods.

FIG. 8 shows word recognition rates as the recognition results. "Observed Sound" represents a recognition result with no adaptive filter, i.e., a recognition result in such a state that the sound is not processed at all. "Solo Speech" represents a recognition result in such a state that the sound is not mixed with self-speech, i.e., that no noise exists. Since the general recognition rate of clean speech is 90 percent, it is apparent from FIG. 8 that the recognition rate was reduced by 20 percent by the influence of the room environment. In the method A, the recognition rate was reduced by 0.87 percent from the observed sound. It is inferred that this reflects the fact that the method A is unstable in the double-talk state in which the self-speech and other's speech are mixed. In the method B, the recognition rate was increased by 4.21 percent from the observed sound, and in the method C, the recognition rate was increased by 7.55 percent from the observed sound. This means that the method C in which the characteristic for each frequency is reflected as a result of processing performed in the frequency domain has better effects than the method B in which processing is performed in the time domain. In the present technique D, the recognition rate was increased by 9.61 percent from the observed sound, and it was confirmed that the present technique D would be a more effective sound-source separation method than the conventional methods A to C.

What is claimed is:

1. A sound-source separation system, comprising:

a known signal storage means which stores known signals output as sound to an environment;

a microphone;

a first processing section which performs frequency conversion of an output signal from the microphone to generate an observed signal of a current frame; and a second processing section which removes an original signal from the observed signal of the current frame generated by the first processing section to extract an unknown signal according to a first model in which the original signal of the current frame is represented as a combined signal of known signals for the current and previous frames and a second model in which the observed signal is represented to include the original signal and the unknown signal, wherein the second processing section extracts the unknown signal according to the first model in which the original signal is represented by convolution between the frequency components of the known signals in a frequency domain and a transfer function of the known signals.

2. The sound-source separation system according to claim 1, wherein the second processing section extracts the unknown signal according to the second model for adaptively setting a separation filter.

* * * * *